United States Patent [19]

Sprung

[11] 4,137,687

[45] Feb. 6, 1979

[54] STRESSED MEMBRANE SPACE ENCLOSURE

[76] Inventor: Philip D. Sprung, 1001 - 10th Ave., SW., Calgary, Alberta, Canada

[21] Appl. No.: 810,900

[22] Filed: Jun. 28, 1977

[51] Int. Cl.[2] ..... E04B 1/32

[52] U.S. Cl. ..... 52/747; 52/63; 52/86; 52/222

[58] Field of Search ..... 52/747, 86, 63, 222; 135/1 R, 4 R

[56] References Cited

U.S. PATENT DOCUMENTS

| | | | |
|---|---|---|---|
| 2,699,739 | 1/1955 | Molke | 52/747 X |
| 3,780,477 | 12/1973 | Sprung | 52/86 |
| 3,811,454 | 5/1974 | Huddle | 52/63 X |
| 3,863,419 | 2/1975 | Hendrich | 52/747 |
| 4,010,300 | 3/1977 | Wallin | 52/222 X |
| 4,035,968 | 7/1977 | Caspar | 52/222 |

*Primary Examiner*—J. Karl Bell

[57] ABSTRACT

A stressed membrane space enclosure having a supporting frame comprising a plurality of spaced individually separable arch-like members with a strip of fabric stretched between each adjacent pair of arches and by means of which separable arches the fabric is tensioned. The feet of the arches rest on load-bearing pads that are individually shiftable as during the frame spreading for the purpose of tensioning the fabric and that each finds its own proper resting place when all the stresses on the structure have been normalized and is then secured against unauthorized movement by ground anchors, thereby achieving the greatest possible strength and stability of the supporting frame. The fabric is applied in reinforced elongated strips one such strip between each adjacent pair of spreadable frame members and stretched to a predetermined tension to bear maximum loads of wind and snow. Reinforcing the strips of fabric in the direction of the tension stress and ensuring a high uniform tension on each strip aids in the discharge or dispersal of heavy environmental loads and the overall strength of the structure. A load regulated power jack may be used to spread the adjacent pairs of frame members to achieve the desired fabric tension and allow the fixing of extendable spacing bars therebetween.

8 Claims, 8 Drawing Figures

STRESSED MEMBRANE SPACE ENCLOSURE

This invention relates to improvements in a stressed membrane space enclosure and more especially to a structure-supported fabric-covered building and method of erecting the same, being an improvement on my U.S. Pat. No. 3,780,477, Dec. 25, 1973.

To meet the demand for an easily erected, low cost, space enclosure various types of tent-like structures both air pressure and frame supported have been devised that satisfy different desires in some degree. From an extensive experience in providing space enclosures in many parts of the world from crowded urban to relatively inaccessible hinterland areas and from equatorial to arctic climes, I have found the most satisfactory low cost, easily transportable, erectable and salvageable, clear span shelter able to withstand the vagaries of savage environment to be a structure-supported stressed membrane enclosure.

Accordingly it is an object of this invention to provide such a shelter in a readily available range of widths and of desired lengths by increments of sub-module or bay lengths in small, lightweight, easily transported components.

A further object is to provide a space enclosing shelter that can be erected and salvaged quickly by inexperienced workmen, using nut and bolt connections.

A further object is to provide such a space enclosure having a supporting structure of spaced arch-like frame members with a membrane cover composed of strips of fabric stretched to a uniform tension by the controlled spreading of the arch-like frame members whereby the magnitude of bearable environmental loads such as wind and snow and the overall strength and stability of the erection are increased.

A further object of the invention is to provide a shelter having a membrane cover of horizontally reinforced fabric strips all under uniform tension exerted in the direction of the fabric reinforcement.

A further object of the invention is the provision of a structure supported stressed membrane space enclosure wherein the fabric cover is stretched to a uniform predetermined tension by the controlled spreading of the spaced arch-like frame members of the supporting structure whose feet are free to shift or float during such fabric-tensioning spreading and each to find its own compensating and stabilizing position.

A still further object is the provision of a stressed membrane space enclosure of the nature and for the purposes described having a supporting structure that includes a plurality of spaced framed members mounted on individually shiftable load-bearing foot pads that, after the spreading of the frame members to tension the membrane and when they have each found their own respective resting places, may then be secured against any unauthorized movement.

To the accomplishment of these and related objects as shall become apparent as the description proceeds, the invention resides in construction, combination and arrangement of parts and method of erection as shall be hereinafter more fully described, illustrated in the accompanying drawings and pointed out in the claims hereunto appended.

Figure 1:
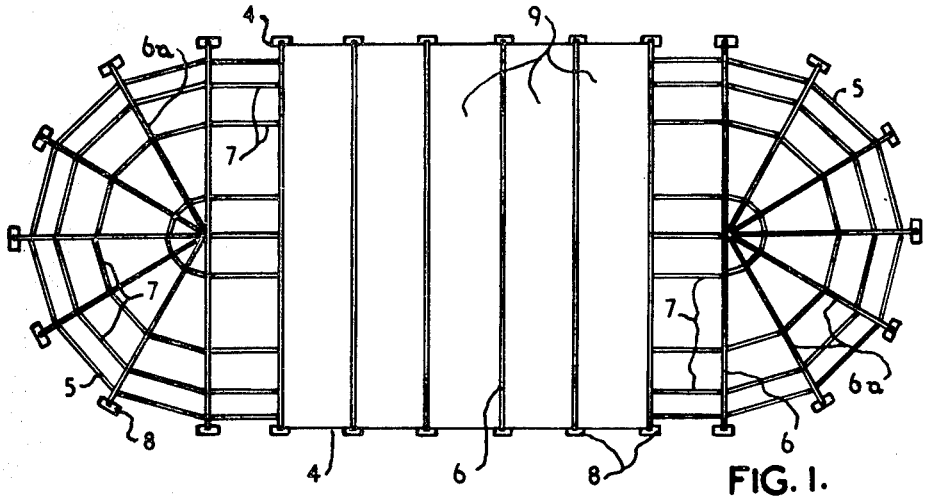
FIG. 1 is a plan view of one form of the invention with its fabric membrane shown applied only to the mid-section.
Figure 2:
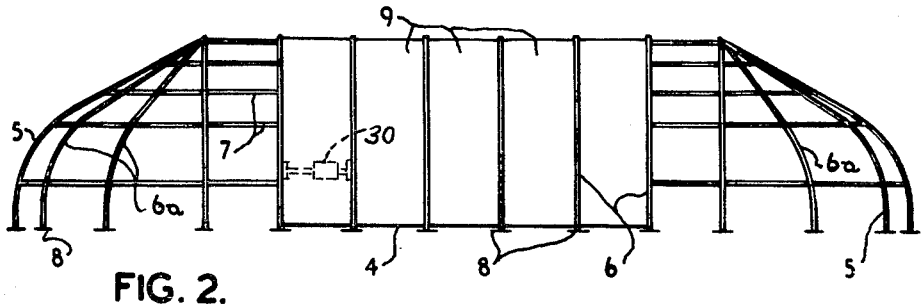
FIG. 2 is a side elevation.
Figure 4:
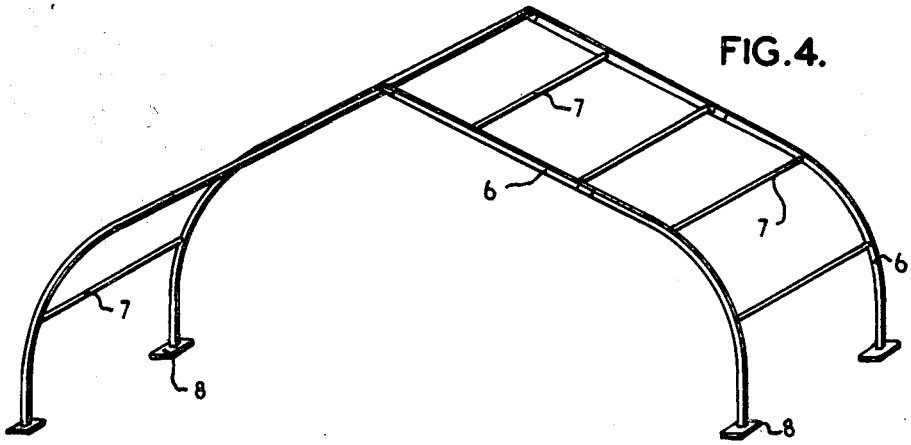
FIG. 4 is an enlarged isometric view of an assembled pair of arch frame members constituting a sub-module or bay.
Figure 3:
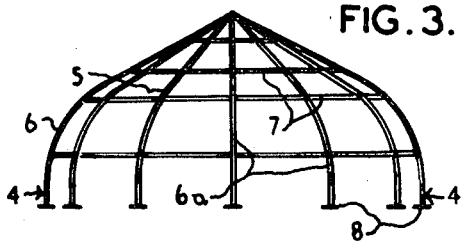
FIG. 3 is an end elevation thereof.

Referring now to FIGS. 1 to 4 inclusive, it will be seen that this embodiment of the invention is in the form of an elongate open span structure with parallel sides 4 and fan-like semi-circular ends 5. Basically the frame consists of a plurality of arch frame members 6 disposed in upstanding spaced apart relation along the length of the building each such arch frame member being disposed transversely with respect to the longitudinal axis of the building. The arch frame members 6 are available in standard widths of 30, 40, 50 and 60 feet, with spans of 120 feet manufactured in the same basic geometry for custom orders. Arch members in the standard span width have a height of approximately one-half the width and are normally assembled in modular 10 foot sections while 15 foot modular sections are recommended for the extra wide spans. At each semi-circular end of the structure a fan of circumferentially spaced half arches $6^a$ is arranged in radial form to converge at the peak of the respective end regular arch member 6.

Extendable spreader bars 7 are installed horizontally between each pair of adjacent arch frame members 6 and/or $6^a$ at selected spaced apart levels. Each arch frame member foot is mounted on a horizontal, load-bearing pad 8 that at the time of the erection of the supporting frame is free to shift in any direction on the ground.

Figure 7:
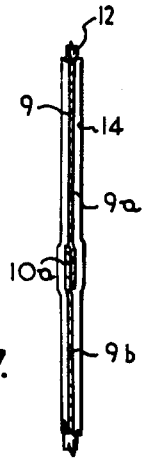
FIG. 7 is an enlarged section as taken on line 7—7 of FIG. 6.

The membrane cover for this structure comprises a plurality of elongate fabric strips 9, each strip extending between a single pair of adjacent arch frame members 6 and/or $6^a$. The construction of these fabric strips 9 and the method of securing their longitudinal edges to the arch frame members is shown in FIGS. 5, 6 and 7.

Because of the demands on these large stressed membrane space enclosures particular attention has been paid to the fabric cover. Preferably the scrim or base fabric strip 9 is a special impervious material such as PVC coated nylon, polyester, fibre glass, "Teflon", "Kevlar", polypropoline or the like resistant to moisture, mildew, insects and such factors, translucent yet treated to withstand extreme temperature changes and to inhibit deterioration from sunlight, and fire retardant being self-extinguishing. To maximize the strength of the total structure that will withstand snow and wind loadings up to 60 lbs./ft.$^2$ (292 kg/m$^2$) and 104 mph. (225 km/hr.), each fabric strip extended between an adjacent pair of arch frame members may be required to bear the full tensioning load of a 10 ton pneumatic jack as the adjacent pair of arch members is being spread. The breaking load of the fabric runs in excess of 600 pounds per square inch of the wrap and weft and its tear strength runs to upwards of 185 pounds on the warp and weft. To meet these exacting requirements the strip 9 is composed of a number of relatively short pieces of fabric $9^a$, $9^b$, $9^c$, etc., connected by overlapped transversely extending joints $10^a$, $10^b$, etc., the overlap being approximately one and one-half inches. These reinforcing overlaps being thermal fusion or welded joints thereby provide transverse reinforcements at intervals spaced longitudinally of the strip that greatly exceed the strength of a single thickness of the fabric. Along each opposite longitudinal edge 11 the fabric is folded over a length of rope 12 running the full length of the strip and the folded over edge with substantial overlap is welded in the manner above mentioned to from a bead 14. It is to be understood that the elongate fabric strips 9 applied between adjacent pairs of parallel frame members 6 are rectangular whereas those fitted between frame members 6 and radial end frame members 6$^a$ and also between adjancet end members 6$^a$ are of appropriate sector shape with their opposite beaded sides converging at the peak.

Figure 5:
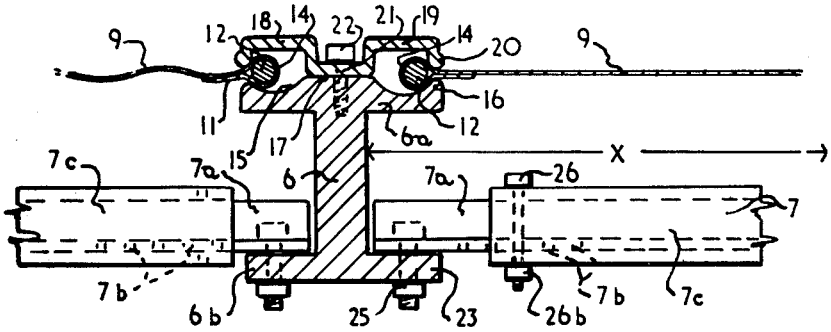
FIG. 5 is a further enlarged section through an arch-like frame member.
Figure 6:
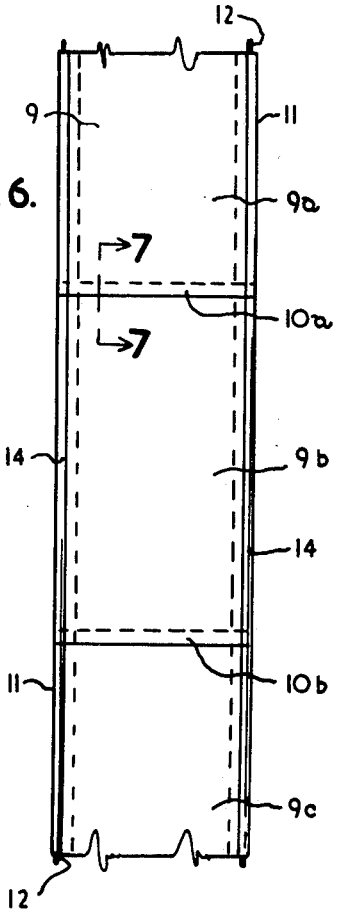
FIG. 6 is an elevation of a part of a reinforced fabric strip.

A preferred manner of securing the beaded edge 11 of the reinforced fabric strip 9 to a frame arch member 6 is seen in FIG. 5. Here the frame member 6 is an I-shaped extrusion having on the exterior face of its outer crosshead 6$^a$ a pair of parallel, spaced, arcuate grooves 15 with rounded outer edges 16 and a central rib 17 that stands higher than the rounded outer edges 16. Mounted on the exterior of this outer crosshead of the arch frame member 6 is a fabric capturing device in the form of an elongate plate 18 of the same width as the crosshead with a pair of spaced channels 19 facing the respective grooves 15 with rounded outer edges 20 confronting and spaced from the grooves rounded edges 16 and having a median ridge 21 between the channels 19 that lies on and is releasably secured to the rib 17 of the arch member outer crosshead by bolts 22. The tubular-like housing constituted by each pair of constituted by each pair of confronting grooves 15 and channels 19 is more than ample to accommodate a beaded fabric strip edge 11 and the constricted gap between their respective confronting rounding outer edges 16 and 20 is sufficient to loosely pass the folded over and welded edge of the fabric strip 9 yet restricted to ensure captively of the thickened bead of such edge.

When applying the membrane cover, it will be seen that the design of this fabric attaching structure allows of the easy longitudinal sliding of the beaded edges of an elongate strip of fabric in the tubular-like housings of an adjacent pair of arches while the frame is slack yet when these reinforced fabric strips are transversely tensioned on the spreading of the arch frame members 6—6$^a$ this fabric securing assembly assures a strong, positive and weather-proof joint as the double thickness overlap of fabric at the beaded edge issues from the constricted gap and the captured thickened bead seats in self-centering and effective weatherproof seal against the inside of the outer edges of the grooves and channel without injury to the fabric.

Following the application of a fabric loose strip 9 between a pair of adjacent arch members 6—6$^a$ the framemembers are spread apart by a load regulated power jack 30 such as a 10-ton pneumatic jack applied as at X to achieve the desired tensioning load on the fabric that normally runs around 10,000 to 12,000 pounds but may lie in the overall range of from 1 to 20,000 pounds depending upon the size of the structure, climatic conditions, building codes, etc. The arch frame member 6 here shown as an extrusion of I-shape in cross-section has an inner crosshead 6$^b$ with a flange 23 extending to each side. Between each crosshead flange 23 and the confronting flange on the next adjacent arch frame member 6 a plurality of the adjustable length compression spreader bars 7 are installed at selected spaced apart levels. The flat base of a male part 7$^a$ in the shape of an inverted T is secured on flange 23 by bolt 25 and projects beyond the flange in the direction of the adjacent member 6 with the flat base having a row of spaced perforations 7$^b$ beyond the edge of the crosshead flange. A tubular-like female part 7$^c$ affixed to the flange of the next adjacent member 6 is longitudinally slidable in telescope relation on the part 7$^a$ and carries near its end a diametrically disposed bolt 26 extendable therethrough that, when the arches are spread to produce the desired tension on the fabric, is passed through the appropriately registering perforation 7$^b$ and secured by nut 26$^b$.

Figure 8:
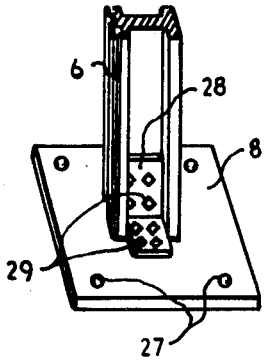
FIG. 8 is an isometric view of an arch foot mounted on its shiftable ground pad.

The load-bearing pad 8 mounted on each arch frame foot is seen in FIG. 8 as a flat horizontal plate of adequate area to support its share of the structure's load having regard to the nature of the underlying ground. It contains a number of perforations 27 to accommodate ground anchors. Here the foot of an arch frame member 6 of I-shape in cross-section is secured to the freely shiftable plate by angle brackets 28 fastened by bolts 29 to both the frame member 6 and the plate 8.

In this embodiment the arch members are preferably fabricated in small lightweight components that can be easily transported and assembled at the site. A flat shiftable load-bearing pad is secured to each arch frame foot and a pair of arches is then set up in spaced relation with a plurality of horizontal spreader bars in retracted condition installed at selected spaced apart levels. Successive arches are added for the length of the building whereupon if the structure is to have a semi-circular end, one leg or half arches are arranged to extend as fan-like radials from the peak of the respective end transverse arches. An elongate strip of transversely reinforced fabric is installed between each adjacent spaced pair of arches with its opposite beaded edges loosely captured in the tubular-like housings provided on the exterior of each arch. With the longitudinally extendable spreader bars freed for expansion, the successive pair of arches are spread as by a powerful pneumatic jack interposed therebetween until the reinforced fabric strip reaches a predetermined tension when the underlying spreader bars are respectively locked in extended condition. During the arch frame spreading each load-bearing arch foot pad is free to shift in any horizontal direction on the ground as the arches adjust to compensate for the substantial compression and tension stresses. When all these stresses have been normalized and each foot pad has acquired its own position than each foot pad is secured as by a suitable drift pin, ground anchor or the like against any further or unauthorized movement.

Due to unique characteristics of the strong, lightweight, spreadable frame, the membrane cover of reinforced elongate fabric strips, the specific nature of joining the fabric to the frame and the method of spreading the frame arches and securing them in fabric uniform tension relation by telescope type compression spreaders have made it possible to provide a stressed membrane space enclosure of unusual strength and durability of lightweight easily assembled and dismantled components and that can be very quickly and cheaply erected by supervised unskilled labour.

The current success of this stressed membrane building of different sizes and uses in wide ranging areas of the world have brought it under excessive examination in both laboratory and experimentally in site testing for fulfillment of building code standards. Wind loading evaluation figures in building codes are based on the assumption that the loaded structural surface is static and stiff whereas the membrane surface of the present structure is dynamic and flexible. The aerodynamic-mechanical interaction of the membrane with the air poses a nonlinear, non-conservative problem of mechanics. As the membrane is dynamically loaded, it not only deflects but also vibrates significantly disturbing the boundary layer and consequently causing changes in the dynamic loading. Load tests have indicated the fabric over a 10 foot submodule span can withstand a high p.s.f. pressure. In arch design tests, both with and without the fabric, in axial stresses and for buckling load, experiments showed an increase in load of 1.4 due to the partial restaint of the fabric. In environmental load simulation tests continued with suitable increments until failure of the structure, it was found that rather than buckling, the arches would fail by yielding at the point of maximum moment. Thus, in the bending case, the fabric provided sufficient restraint to the compression flange to prevent instability prior to generation of compression yield stresses proving conclusively the fabric-frame interaction on the stability of the entire configuration and the significance of qualized fabric tension on development of optium strength of the frame-membrane composite through minimization of membrane stress concentration. In large, clear span space enclosures (up to 120 feet in width and of any desired length) the overall strength of the structure to withstand snow loads of 60 p.s.f. and winds of 140 m.p.h. and to exceed building code standards by a wide margin of safety emphasize the need to eliminate all potential weakness in the assembly and maximize the gain from complete stress equalization. In these circumstances the shape of the building, the system of joining the membrane and supporting structure and the increased load bearing strength of the frame with stressed fabric restaint assume added importance.

At the time of erection of the structure, it may be found desirable to assemble the supporting structure components loosely to facilitate sliding the fabric strips in place in the frame then when the membrane cover has been applied and the frame members are spread to tension the fabric strips, each frame pad is free to shift longitudinally, transversely or radially to its own compensating and stabilizing position until all the stresses on the structure have been normalized and it finds its own resting place whereupon it is secured by suitable ground anchors against any unauthorized movement.

In conclusion, while it will be seen that mounting each arch-like frame member on a pad that is initially free to shift in any direction on the ground expedites the erection of the skeletal supporting structure and facilitates the application of the fabric strips thereto, a particular sdvantage lies in the ease with which the structures's compression members can adjust their ground positions as the frame members are being spread and to compensate for the substantial tensions of the strong reinforced fabric strips. By thus allowing all the stresses of compression and tension to normalize before the frame supporting pads are pinned down, the overall strength of this total space enclosure is greatly enhanced because of the complete stress equalization. From the foregoing description taken in conjunction with the attached drawings of a preferred form of my stressed membrane space enclosure, it will be apparent to thosed skilled in the art to which this invention appertains that this embodiment is susceptible to modification, variation and change without departing from the proper scope or fair meaning of the appended claims.

What is claimed as new is:

1. The method of building a space enclosing membrane covered structure comprising the steps of:

(a) erecting a plurality of transversely disposed longitudinally spaced arch-like frame members wit each arch foot mounted on an individual pad freel shiftable in any direction on the ground;

(b) securing by its opposite edges an elongate strip of fabric in a loose condition between each pair of adjacent transversely disposed frame members;

(c) horizontally spreading successively at spaced apart levels and in a direction longitudinally of the structure by a removable load regulated power jack each fabric-connected pair of arch-like frame members until the intermediate fabric strip throughout its length reaches a predetermined uniform tension with the arch foot pads each free to shift in any direction on the ground in response to such spreading action, and (d) securing each said pair of frame members in such spread, predetermined uniform fabric tensioning spaced condition.

2. The method of claim 1, wherein each arch-like frame member foot pad is a flat horizontal plate free to shift in any direction on the ground and the fabric-connected pairs of frame members are spread apart successively at different levels by a load regulated power jack temporarily inserted at selected levels between each successive pair of frame members and actuated to apply a uniform predetermined fabric strip tensioning load to all parts of the strip within the range of 1 to 20,000 pounds with the frame member foot pads individually shifting position in any direction on the ground in response to the stresses applied and a spreader is secured in properly extended position between said pair of frame members at selected levels to maintain the uniform predetermined fabric tension load before the temporarily inserted power jack is removed.

3. The method of claim 2, wherein each adjacent pair of arch members is spread apart by a load regulated power jack applying a uniform predetermined fabric tensioning load in the normal range of approximately 10,000 to 12,000 pounds.

4. The method of claim 2, including the further step after the spreading of successive pairs of the frame members in a direction longitudinally of the structure for the tensioning of the fabric strips with the resultant cumulative movement of previously spread pairs of arches of finally securing each of said pads in non-shiftable position with ground anchors when it has found its own resting place.

5. A stressed membrane space enclosure comprising:

(a) a supporting structure including a plurality of transversely disposed longitudinally spaced arch-like frame members;

(b) a horizontal load-bearing pad underlying and connected to each foot of each such frame member freely shiftable in any direction on the ground;

(c) an elongate fabric strip between each adjacent pair of frame members being connected by its opposite edges to said respective pair of spaced frame members and stretched transversely throughout its length to a uniform predetermined tension within the range of 1 to 20,000 pounds;

(d) spreaders between each said pair of movable frame members spaced apart at different levels and secured in extended position to maintain the intermediate fabric strip at the uniform predetermined tension;

(e) and ground anchors securing each individual pad against unuathorized movement after all the frame members of the supporting structure have been spread apart in the tensioning of the fabric with resultant cumulative longitudinal extension of the structure and the pad has found its own resting place with the stresses on the structure normalized.

6. A stressed membrane space enclosure according to claim 5, wherein the elongate fabric strip comprises a plurality of pieces of fabric connected in flat overlapped transversely extending joints lying in the plane of the strip by thermal fusion welds to transversely reinforce and greatly enhance the load bearing strength thereof and to enable the fabric strip to withstand the application of high uniform transverse tension, the fabric overlap of the elongate fabric strip transverse welds being approximately one and one-half inches.

7. The stressed membrane space enclosure of claim 6, wherein the arch-like frame member exteriorly carries a fabric strip-capturing device that together with the frame member provides a tubular-like housing with a constricted gap and wherein each longitudinal edge of the fabric strip with its flat overlapped transversely extending reinforcing joint has an enlarged bead formed by an edge of the strip being doubled back in a substantial overlap over a length of rope and secured by a thermal fusion weld, the tubular-like housing on the frame member being more than ample to accommodate the beaded edge of the fabric strip and the constricted gap too limited to release it, whereby the doubled back welded overlap edge of the strip issues from the gap of the fabric strip-capturing device while the enlarged bead seats in self-centering and sealing engagement within the housing.

8. The stressed membrane space enclosure of claim 6, wherein said reinforced elongate fabric strip is of impervious material chosen from the group comprising PVC coated nylon, polyester, fibre glass, "Teflon", "Kevlar" and polypropoline resistant to moisture mildew and insects, translucent, able to withstand extreme temperatures, to inhibit deterioration from sunlight, is fire retardant and self-extinguishing and with its opposite edges so captured by the adjacent pair of frame members between which it is connected as to be able to bear the full tensioning load of a 10 ton jack applied to spread the said pair of frame members.

* * * * *